US012465803B2

(12) United States Patent
Pritchett et al.

(10) Patent No.: US 12,465,803 B2
(45) Date of Patent: Nov. 11, 2025

(54) WEIGHTLIFTING RACK ASSEMBLY

(71) Applicant: Coulter Ventures, LLC., Columbus, OH (US)

(72) Inventors: Martin Pritchett, Columbus, OH (US); William Henniger, Columbus, OH (US); Ahmik Jones, Upper Arlington, OH (US)

(73) Assignee: Coulter Ventures, LLC., Columbus, OH (US)

( * ) Notice: Subject to any disclaimer, the term of this patent is extended or adjusted under 35 U.S.C. 154(b) by 164 days.

(21) Appl. No.: 18/063,170

(22) Filed: Dec. 8, 2022

(65) Prior Publication Data

US 2023/0173323 A1 Jun. 8, 2023

Related U.S. Application Data

(60) Provisional application No. 63/287,442, filed on Dec. 8, 2021.

(51) Int. Cl.
*A63B 21/062* (2006.01)
*A63B 21/078* (2006.01)

(52) U.S. Cl.
CPC ..... *A63B 21/062* (2013.01); *A63B 21/078* (2013.01)

(58) Field of Classification Search
CPC ..... A63B 21/062; A63B 21/078; A63B 17/04; A63B 1/00; A63B 1/005; A63B 17/00; A63B 17/02; A63B 21/00047; A63B 21/15; A63B 21/16; Y10T 403/44; Y10T 403/341; Y10T 403/342; Y10T 403/347;
(Continued)

(56) References Cited

U.S. PATENT DOCUMENTS

D932,574 S * 10/2021 Adams ..... D21/694
12,330,010 B2 * 6/2025 Crandall ..... A63B 21/0615
(Continued)

FOREIGN PATENT DOCUMENTS

AU 2021221671 A1 * 9/2022 ..... E04B 1/2403
WO WO-2022084671 A2 * 4/2022 ..... A01G 9/28

OTHER PUBLICATIONS

Titan Fitness Rack Mounted (https://www.walmart.com/ip/Titan-Fitness-Rack-Mounted-Dual-Pull-Up-Stabilizer-Bar-Fits-T-3-or-X-3-Series-Power-Racks-32mm-Grip-2-x-3-Stabilizer-Bar-Power-Rack-Connector/939895873; achieved Apr. 22, 2021; accessed Aug. 12, 2024Z) (Year: 2021) (Year: 2020).*
(Continued)

*Primary Examiner* — Loan B Jimenez
(74) *Attorney, Agent, or Firm* — Banner & Witcoff, Ltd.

(57) ABSTRACT

A weight rack assembly may include a plurality of vertical frame members and a plurality of lateral frame members extending between the plurality of vertical frame members. The weight rack assembly may also include a first lateral frame member that includes a gusseted end bracket at one end, where the gusseted end bracket includes a base plate, a lateral extension, a vertical extension, and a top gusset that extends along a side of the first lateral frame member and where the top gusset extends from an upper edge of the lateral extension. The weight rack assembly may further include a second lateral frame member that includes a bottom end plate at one end, where the bottom end plate includes a tab that extends from a lower surface of the bottom end plate and is received in a slot on a foot plate.

19 Claims, 18 Drawing Sheets

(58) Field of Classification Search
CPC ..... Y10T 403/4602; F16B 12/50; Y10S 248/903; E04B 1/19; E04B 1/1903
See application file for complete search history.

(56) References Cited

U.S. PATENT DOCUMENTS

| | | | | |
|---|---|---|---|---|
| 2012/0083392 | A1 | 4/2012 | Taranto | |
| 2013/0165827 | A1 | 6/2013 | Liu | |
| 2014/0087928 | A1 | 3/2014 | Luedeka | |
| 2015/0076092 | A1 | 3/2015 | Tambornino et al. | |
| 2019/0184220 | A1* | 6/2019 | Wilkinson | A63B 71/0036 |
| 2020/0222745 | A1* | 7/2020 | Leipheimer | A63B 23/03525 |
| 2023/0173329 | A1* | 6/2023 | Nesemeier | A63B 23/1218 482/103 |
| 2025/0186856 | A1* | 6/2025 | Iverson | A63B 17/04 |
| 2025/0205543 | A1* | 6/2025 | Henniger | A63B 21/169 |

OTHER PUBLICATIONS

Mar. 21, 2023—(WO) ISR and WO—App PCT/US2022/081148.
Jul. 17, 2024—(EP) Rules 161(2) and 162 EPC Communication—App 22905362.4.
May 16, 2025—(AU) Office Action—App 2022405540.

* cited by examiner

WEIGHTLIFTING RACK ASSEMBLY

CROSS-REFERENCE TO RELATED MATTERS

This application claims the benefit of and priority to U.S. Provisional Application No. 63/287,442, filed on Dec. 8, 2021, the content of which is expressly incorporated by reference in its entirety for any and all non-limiting purposes.

TECHNICAL FIELD

This disclosure relates to weightlifting rack assemblies for use with weightlifting machines, and more specifically, to weightlifting rack assemblies that can be used with weightlifting machines that may include cable-based weightlifting machines or for traditional weightlifting exercises.

BACKGROUND

Various different types of weightlifting racks exist, which provide users the ability to perform a weightlifting exercise or use a weightlifting machine that includes a resistance element that provides the resistance to the user for the weightlifting exercise and allows movement in a controlled manner. The weightlifting rack may provide a stable platform for a variety of weightlifting machines. These weightlifting machines may include one or more pulleys and cables to redirect the movement of a resistance element to move upwards when a user pushes downward on a grip member, such as a weightlifting machine for doing a lat pulldown exercise.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Some aspects of this disclosure may relate to a weight rack assembly that comprises: (a) a plurality of vertical frame members, where each of the plurality of vertical frame members comprises a rectangular cross-sectional shape; and (b) a plurality of lateral frame members extending between the plurality of vertical frame members, where each of the plurality of lateral frame members comprises a rectangular cross-sectional shape. The weight rack assembly may further comprise a first lateral frame member of the plurality of lateral frame members that includes a first gusseted end bracket at a first end of the first lateral frame member, where the first gusseted end bracket includes a first base plate at the first end of the first lateral frame member, a first lateral extension extending laterally from the first base plate, a first vertical extension extending vertically downward from the first base plate, and a first top gusset that extends from an upper edge of the first lateral extension along a side surface of the first lateral frame member. A first fastener may extend through a first opening in the first vertical extension of the first gusseted end bracket to releasably connect the first lateral frame member to a first vertical frame member of the plurality of vertical frame members. The weight rack assembly may further comprise a second lateral frame member of the plurality of lateral frame members, where the second lateral frame member includes a second gusseted end bracket that has a second base plate at a first end of the second lateral frame member, a second lateral extension extending laterally from the second base plate, a vertical extension extending vertically downward from the second base plate, and a second top gusset that extends from an upper edge of the second lateral extension along a side surface of the second lateral frame member. The first lateral frame member and the second lateral frame member may be arranged on opposite sides of the first vertical frame member. A second fastener may releasably connect the first lateral frame member to a second lateral frame member of the plurality of lateral frame members.

In some examples, the first gusseted end bracket may be integrally joined at the first end. The first lateral frame member may include a second gusseted end bracket at a second end of the first lateral frame member opposite the first end, where the second gusseted end bracket includes a second base plate at the second end of the first lateral frame member, a second lateral extension extending laterally from the second base plate, a second vertical extension extending vertically downward from the second base plate, and a second top gusset that extends from an upper edge of the second lateral extension along the side surface of the first lateral frame member. The first gusseted end bracket may include a first side gusset extending between the first vertical extension and an exterior facing surface of the first lateral frame member. The first top gusset, the first lateral extension, the first vertical extension, and the first base plate may be integrally formed as a single piece of metal plate. In some examples, the weight rack assembly may further include a second lateral frame member of the plurality of lateral frame members positioned below the first lateral frame member proximate a bottom of the weight rack assembly. The second lateral frame member may include a bottom end plate at one end, where the bottom end plate includes a tab that extends from a lower surface of the bottom end plate, where the tab of the bottom end plate may be received in a slot on a foot plate.

Other aspects of this disclosure may relate to a weight rack assembly that comprises: (a) a plurality of vertical frame members, where each of the plurality of vertical frame members comprises a rectangular cross-sectional shape; (b) a plurality of lateral frame members extending between the plurality of vertical frame members, where each of the plurality of lateral frame members comprises a rectangular cross-sectional shape; and (c) a foot plate located at a bottom end of a first vertical frame member of the plurality of vertical frame members. The weight rack assembly may also include a first lateral frame member of the plurality of lateral frame members that comprises a bottom end plate at a first end of the first lateral frame member, such that the bottom end plate is connected to the first vertical frame member at the first end of the first lateral frame member. The bottom end plate may include an upper end, a lower end opposite the upper end, a first side surface that extends from the upper end to the lower end, and a second side surface opposite the first side surface, and a tab that extends from the lower end of the bottom end plate, where the tab of the bottom end plate is received in a slot on the foot plate. The bottom end plate may be integrally joined at the first end of the first lateral frame member. In some examples, the bottom end plate may further include a gusset that extends from the lower end toward the second side surface. The gusset may have a height within a range of 30 percent and 70 percent of a height of the bottom end plate, where the height of the bottom end plate is measured from the upper end to the lower end. A first fastener may extend through an opening in the bottom end plate to releasably connect the first lateral frame member to the first vertical frame member. The lower end of the bottom end plate may rest on a top surface of the foot plate. A second lateral frame member of the plurality of lateral frame members may include a gusseted end bracket at a first end of the second lateral frame member, where the gusseted end bracket includes a base plate at the first end of the second lateral frame member, a lateral extension extending laterally from the base plate, a vertical extension extending vertically downward from the base plate, and a top gusset that extends from an upper edge of the lateral extension along a side surface of the second lateral frame member.

Yet other aspects of the disclosure may relate to a weight rack assembly that comprises: (a) a plurality of vertical frame members, where each of the plurality of vertical frame members comprises a rectangular cross-sectional shape; (b) a plurality of lateral frame members extending between the plurality of vertical frame members, where each of the plurality of lateral frame members comprises a rectangular cross-sectional shape. The weight rack assembly may further include a first lateral frame member of the plurality of lateral frame members that comprises a gusseted end bracket that is integrally joined at a first end, where the gusseted end bracket includes a base plate at the first end of the first lateral frame member, a lateral extension extending laterally from the base plate, a vertical extension extending vertically downward from the base plate, and a top gusset that extends from an upper edge of the lateral extension along a side surface of the first lateral frame member. A first fastener may releasably connect the first lateral frame member to a first vertical frame member of the plurality of vertical frame members. The weight rack assembly may further comprise a foot plate located at a bottom end of the first vertical frame member; and a second lateral frame member of the plurality of lateral frame members that includes a bottom end plate that is integrally joined at a first end of the second lateral frame member, such that the bottom end plate is connected to the first vertical frame member at the first end of the second lateral frame member. The bottom end plate may comprise an upper end, a lower end opposite the upper end, a first side surface that extends from the upper end to the lower end, and a second side surface opposite the first side surface, and a tab that extends from the lower end of the bottom end plate, where the tab of the bottom end plate may be received in a slot on the foot plate. A second fastener may releasably connect the second lateral frame member to the first vertical frame member. The top gusset may have a top surface that is below a top surface of the first lateral frame member. In some examples, the top gusset may be integrally joined to the side surface of the first lateral frame member. The bottom end plate may further include a gusset that extends from the lower end toward the second side surface, and the gusset may have a height within a range of 30 percent and 70 percent of a height of the bottom end plate, where the height of the bottom end plate is measured from the upper end to the lower end.

DESCRIPTION OF THE DRAWINGS

To allow for a more full understanding of the present disclosure, it will now be described by way of example, with reference to the accompanying drawings in which.

DETAILED DESCRIPTION

Figure 1:
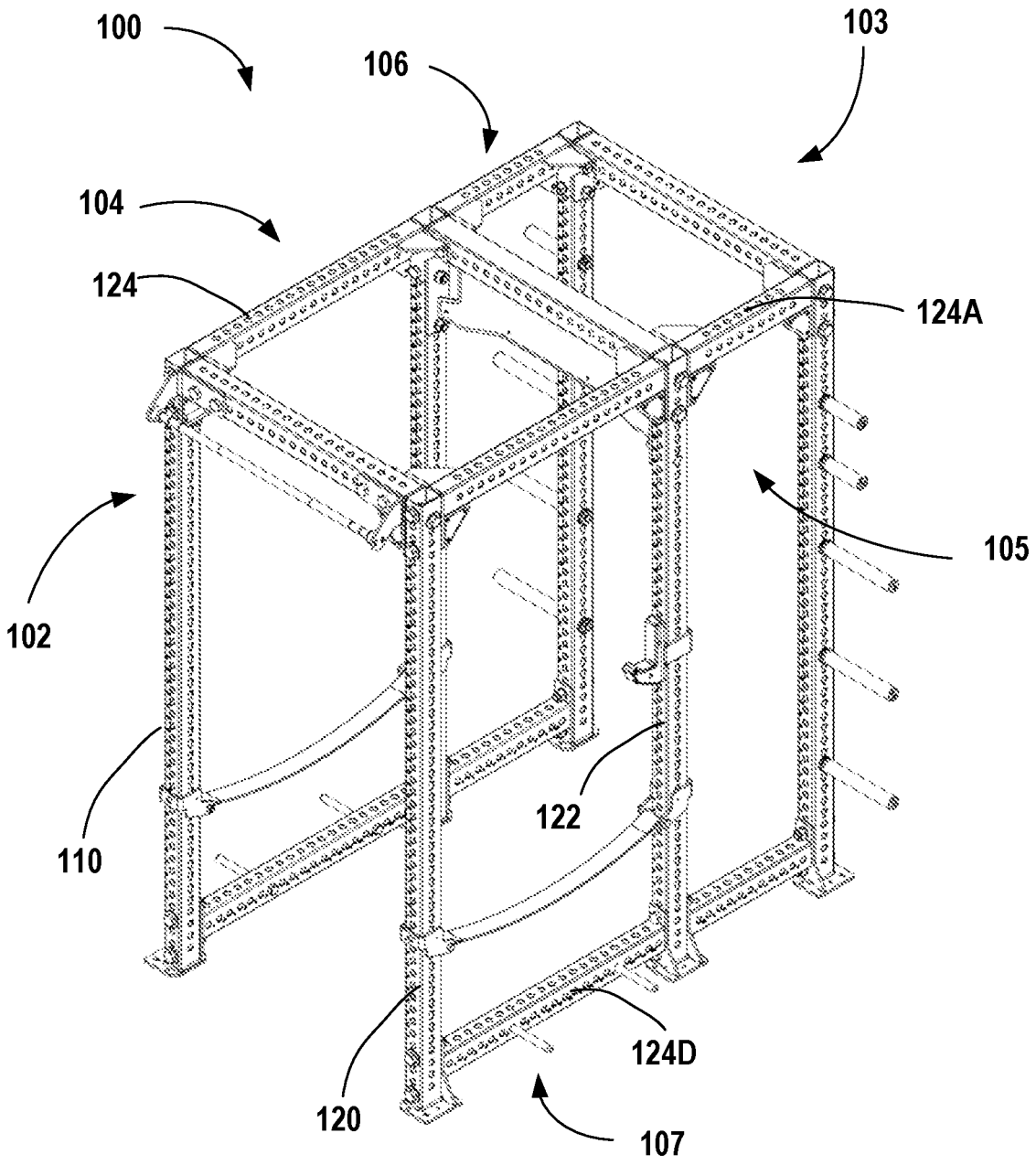
FIG. 1 illustrates a perspective view of an exemplary weightlifting rack assembly, in accordance with aspects of the disclosure.
Figure 2:
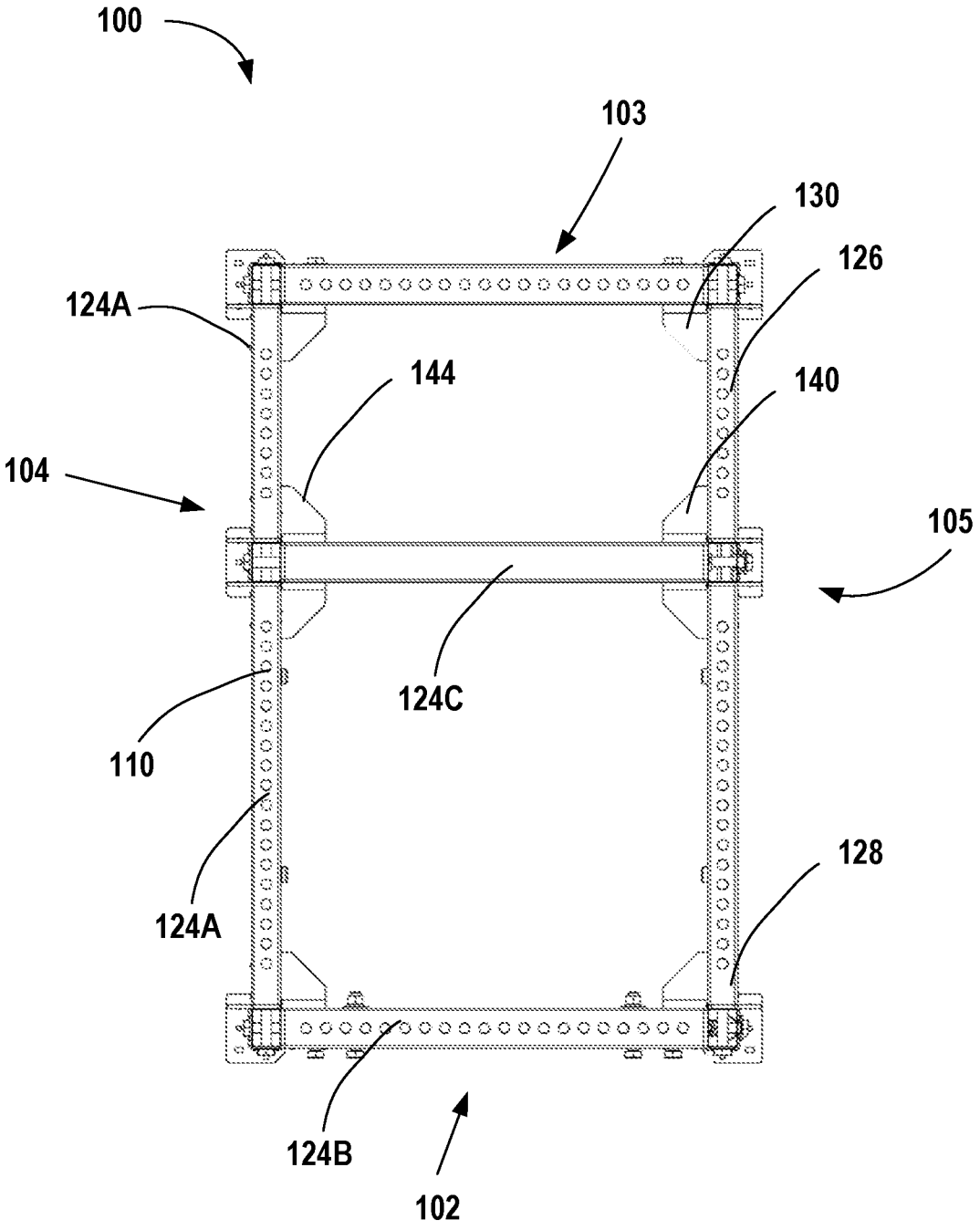
FIG. 2 illustrates a top view of the weightlifting rack assembly of FIG. 1 with some components removed, in accordance with aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "bottom," "front," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Integral joining technique" or means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

"Substantially parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, this disclosure relates to a weightlifting rack assembly that may support various weightlifting machines or weightlifting apparatuses.

Figure 3:
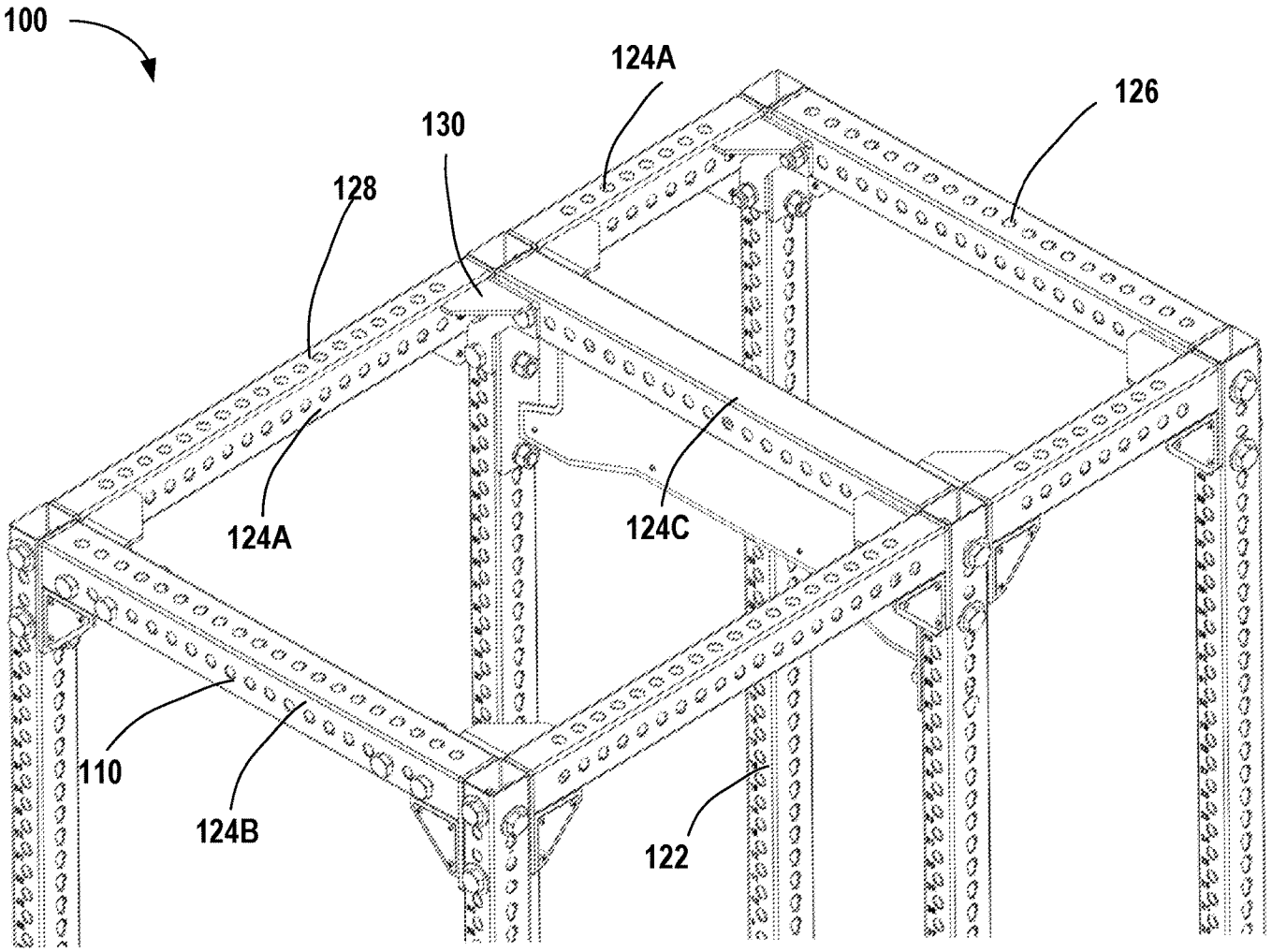
FIG. 3 illustrates a perspective view of a portion of the weightlifting rack assembly of FIG. 2, in accordance with aspects of this disclosure.
Figure 4:
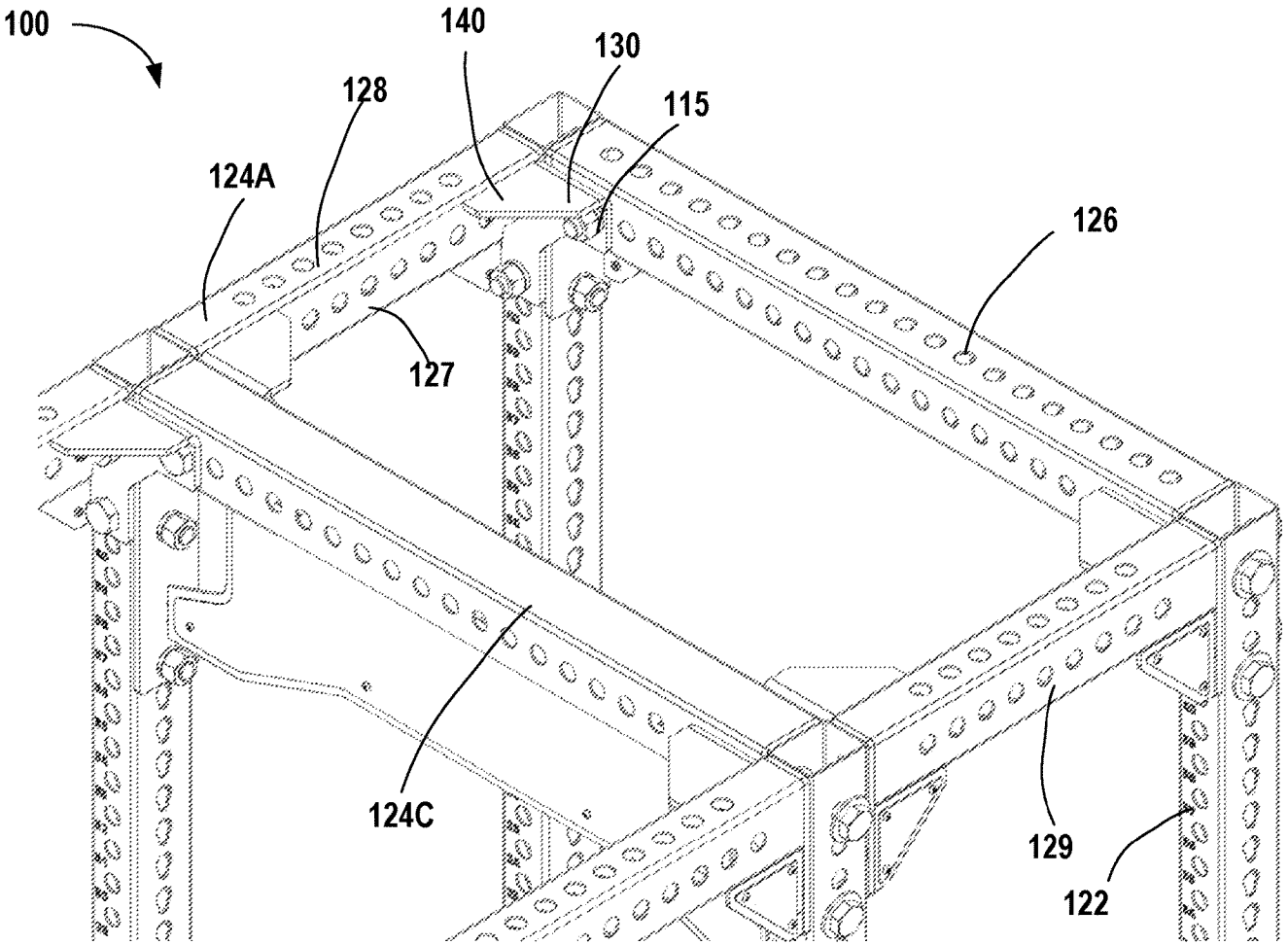
FIG. 4 illustrates a perspective view of an upper portion of the weightlifting rack assembly of FIG. 2, in accordance with aspects of this disclosure.
Figure 5:
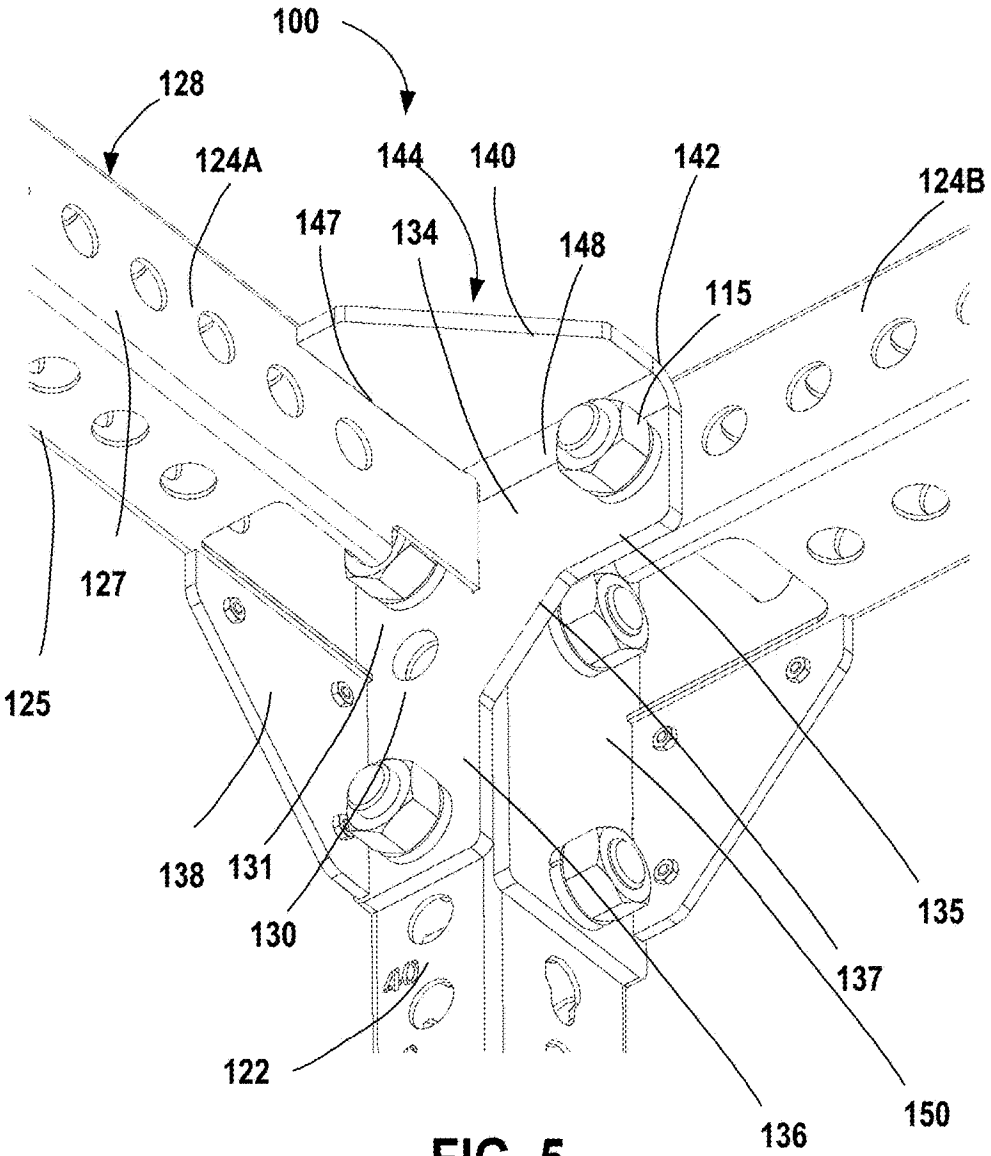
FIG. 5 illustrates a perspective view of an exemplary joint of the weightlifting rack of the weightlifting rack assembly of FIG. 2, in accordance with aspects of this disclosure.

FIG. 1 illustrates an example embodiment of a weight rack assembly 100 that includes a frame 110 and one or more weightlifting structures connected to and/or supported by the frame 110, including one or more shelves, barbell racks, and body weight exercise supports (e.g., bars, handles, and other structures for use in body weight exercises such as chin-ups, climbing, and others), and weightlifting accessories and mechanisms. The weight rack assembly 100 may have a front end 102, a rear end 103, a left side 104, and a right side 105, a top end 106, and a bottom end 107. FIGS. 2-12 illustrate views of the weight rack assembly 100 without the weightlifting structures. The frame 110 may include an arrangement of frame members 120, including a plurality of vertical frame members 122 that are connected together with a plurality of lateral frame members 124 extending between the plurality of vertical frame members 122. For example, the frame 110 illustrated in FIG. 1 is primarily formed by a plurality of structural support members or frame members 120 in the form of metal bars, which may be arranged and connected to each other as vertical beams, horizontal or lateral crossbeams, and angular beams to support the various structures of the weight rack assembly 100. The vertical and lateral frame members 122, 124 as shown in FIG. 1 may be formed as rectangular metal tubes having four side surfaces defining a hollow interior, where at least one of side surfaces may include a plurality of openings or fastener holes 126 arranged at regular intervals along the lengths of frame member 120. As known to one skilled in the art, a rectangular tube may have either a square cross-sectional shape where each side surface has the same width or rectangular cross-sectional shape where a first side surface may have a different width than its adjacent side surface. For example, the weight rack assembly 100 shown in FIGS. 1-12 may have rectangular cross-sectional shaped tubes with a different width than its adjacent side surface, and the weightlifting rack assembly 200 in FIGS. 13-18 may have square shaped cross-sectional shaped tubes where each side surface has the same width. Additionally, the plurality of openings 126 may be identical in shape and size as well as evenly spaced apart from one another along at least a portion of a length of each frame member. In some configurations, the openings 126 on each surface may be the same shape, such as circular openings, while in other configurations, the openings 126 may not be the same shape on each surface. For example, as shown in FIGS. 3-5, the vertical frame member 122 has circular openings 126 on a first surface and a plurality of circular and elongated openings 126 spaced along a second surface that is adjacent to the first surface. A single surface of a frame member 120 may include a mixture of different types of openings 126 in one embodiment. It is understood that opposing openings 126 (i.e., located directly across from each other) may be axially aligned along the length of the frame member 120 and have the same shapes. Alternatively, in some embodiments, the frame members 120 may include an L-shape or U-shaped structure with a plurality of openings 126 arranged along the length of each surface. This arrangement of fastener holes 126 may permit fasteners (not shown) to extend into or through each frame member 120 in two transverse directions for connection of various components to any side of each frame member 120, including weightlifting structures, other frame members 120, and other structures. Suitable fasteners include pins (including cotter pins or other locking pins), bolts and other threaded connectors, clamps, and other types of fasteners. The weight rack assembly 100 and frame 110 structured in the manner illustrated in FIGS. 1-12 and described herein permits construction in a modular manner to provide a wide variety of configurations as desired, including customizable sizes, layouts, and supported weightlifting structures. It is understood that the weight rack assembly 100 and frame 110 of FIGS. 1-12 are depicted in a simple form, which may be larger and more complex, with multiple weightlifting structures connected thereto.

Additionally, the frame 110 may also include connecting structures for connecting the frame members 120 together to form the frame 110. The connecting structures may include a gusseted end bracket 130, an end bracket 150, and a bottom end plate 160. These connecting structures may help to stabilize the vertical and lateral frame members 122, 124 together to provide a stable platform for various weightlifting machines. The frame 110 may include a plurality of gusseted end brackets 130, end brackets 150, and bottom end plates 160 as shown in FIG. 1. The gusseted end brackets 130, end brackets 150, and bottom end plates 160 may be integrally joined to various lateral frame members 124, such as by using an integral joining technique, and removably joined to other frame members 122, 124. As described in more detail below, the gusseted end brackets 130, straight end brackets 150, and bottom end plates 160 each comprise one or more fastener holes 132, 152, 162 that are configured to receive a fastener 115 that may also extend into a corresponding fastener hole 126 in a vertical frame member 122 to releasably connect the lateral frame members 124 to the vertical frame members 122. By having the lateral frame members 124 and the vertical frame members 122 releasably connected, the weightlifting rack assembly 100 may be assembled and disassembled into various configurations.

Figure 6:
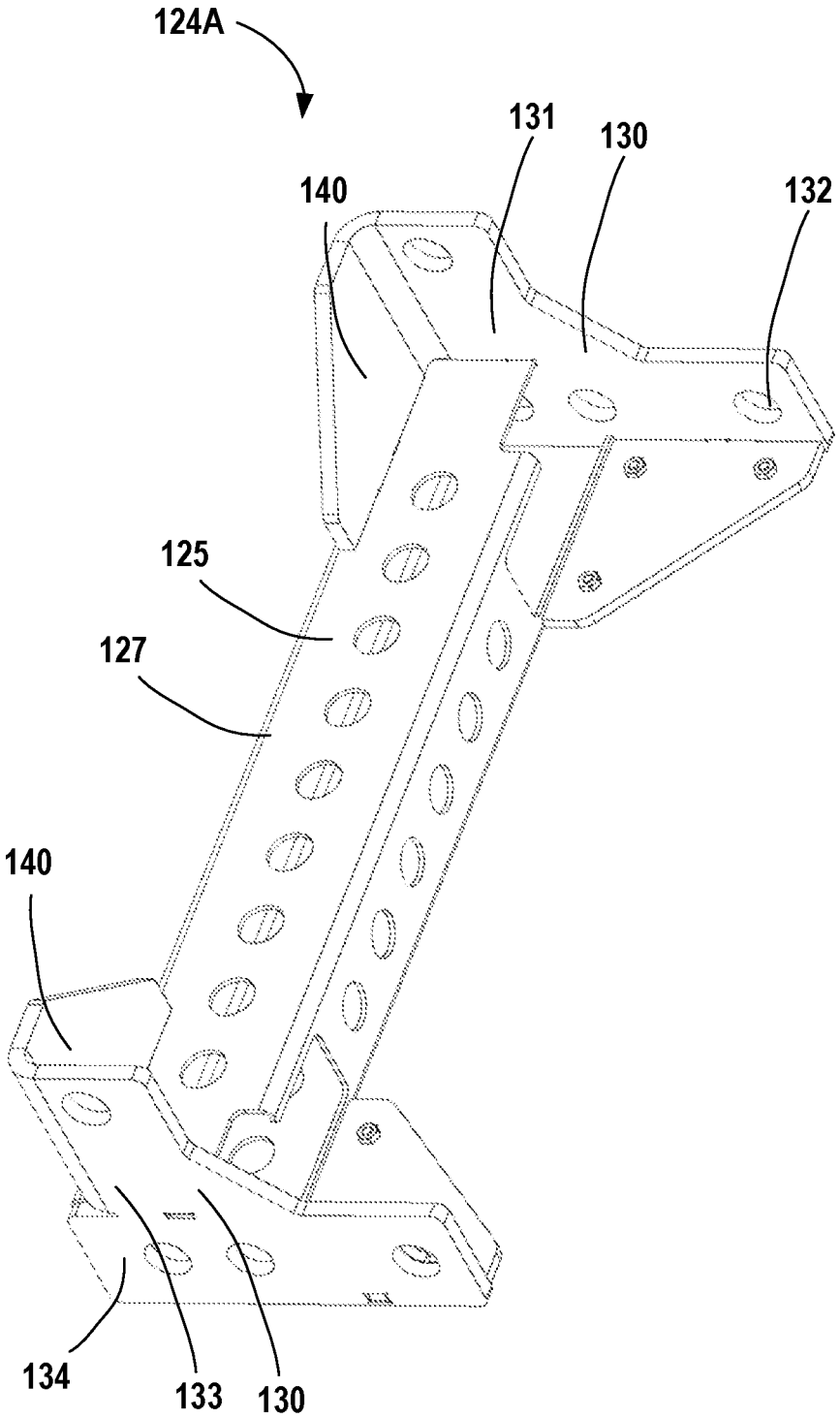
FIG. 6 illustrates a perspective view of a beam with exemplary gusseted end brackets of the weightlifting rack assembly of FIG. 2, in accordance with aspects of this disclosure.

As shown in FIGS. 2-5, the gusseted end brackets 130 may be used to connect upper lateral frame members 124A to the vertical frame members 122 and/or to other upper lateral frame members 124. In the illustrated examples, the gusseted end brackets 130 may be connected to the lateral frame members 124A that are arranged in a front end 102 to rear end 103 direction. In some examples, the lateral frame members 124A with the gusseted end brackets 130 may be arranged in a left to right direction. The lateral frame members 124A that include the gusseted end brackets 130 may be arranged on opposite sides of a vertical frame member 122. For example, a first lateral frame member 124A that has gusseted end brackets 130 may be releasably connected to one side of a vertical frame member 122 and a second lateral frame member 124A that also has gusseted end brackets 130 may be releasably connected to the vertical from member on an opposite side as the first lateral frame member 124A. FIG. 6 illustrates a lateral frame member 124A that includes a gusseted end bracket 130 connected at each end of the beam member 125, such as by welding or other integral joining technique, however it is contemplated that a lateral frame member 124A may be arranged with a gusseted end bracket 130 at only one end and different connecting structure at the other end. The gusseted end brackets 130 may include a plurality of fastener holes 132 that extend through a base plate 134, where the base plate 134 may include a lateral extension 135 that extends laterally from the base plate 134 and a vertical extension 136 that extends vertically downward from the base plate 134. The lateral extension 135 and the vertical extension 136 may extend in a substantially perpendicular direction to each other, such that the base plate 134 generally has an "L" shape. The lateral and vertical extensions 135, 136 may also include a base gusset 137 that extends between the lateral and vertical extensions 135, 136. The base plate 134 may have a front surface 131 that connects to the end of the beam member 125 and a rear surface 133 opposite the front surface 131. In addition, the gusseted end bracket 130 may include a top gusset 140 that extends from an upper edge 142 of the lateral extension 135 in a direction substantially parallel to and along a side surface 127 of the lateral frame member 124A. The top gusset 140 may have a top surface 144 that is coplanar with or below a top surface 128 of its corresponding lateral frame member 124. Accordingly, none of the top gussets 140 of will be above any of the top surfaces 128 of the lateral frame members 124A. The top gusset 140 may be arranged to extend along an outer side surface 127 of its corresponding lateral frame member 124A. The side surface 127 may be located on an inboard side of the lateral frame member 124A. The top gusset 140 may also be integrally joined to the side surface 127 or may extend along the side surface 127 without being fixedly attached to its corresponding lateral frame member 124A. The top gusset 140 may brace the lateral frame member 124A against other vertical or lateral frame members 122, 124 to help to reduce any side-to-side and fore and aft movement of the frame 110. In addition, the gusseted end bracket 130 may also include a side gusset 138 that extends between the vertical extension 136 and an exterior facing outward surface 129 of its corresponding lateral frame member 124A. The side gusset 138 may be integrally joined to a lower edge of the exterior facing outward surface 129 or may extend along the side surface 127 without being fixedly attached to its corresponding lateral frame member 124A.

The top gusset 140 may have a generally triangular shape. In the illustrated examples, a length of a first side 147 of the top gusset 140 may be essentially the same length as a second side 148 of the top gusset 140 that extends along the lateral extension 135. In some examples, the lengths of these sides may be different.

The top gusset 140 may be formed by a forming or bending operation such that the top gusset 140 is integrally formed as a single piece of metal plate with the base plate 134, the lateral extension 135, and the vertical extension 136. The top gusset 140 may then be formed to its final shape with a pressing or bending operation.

Figure 7:
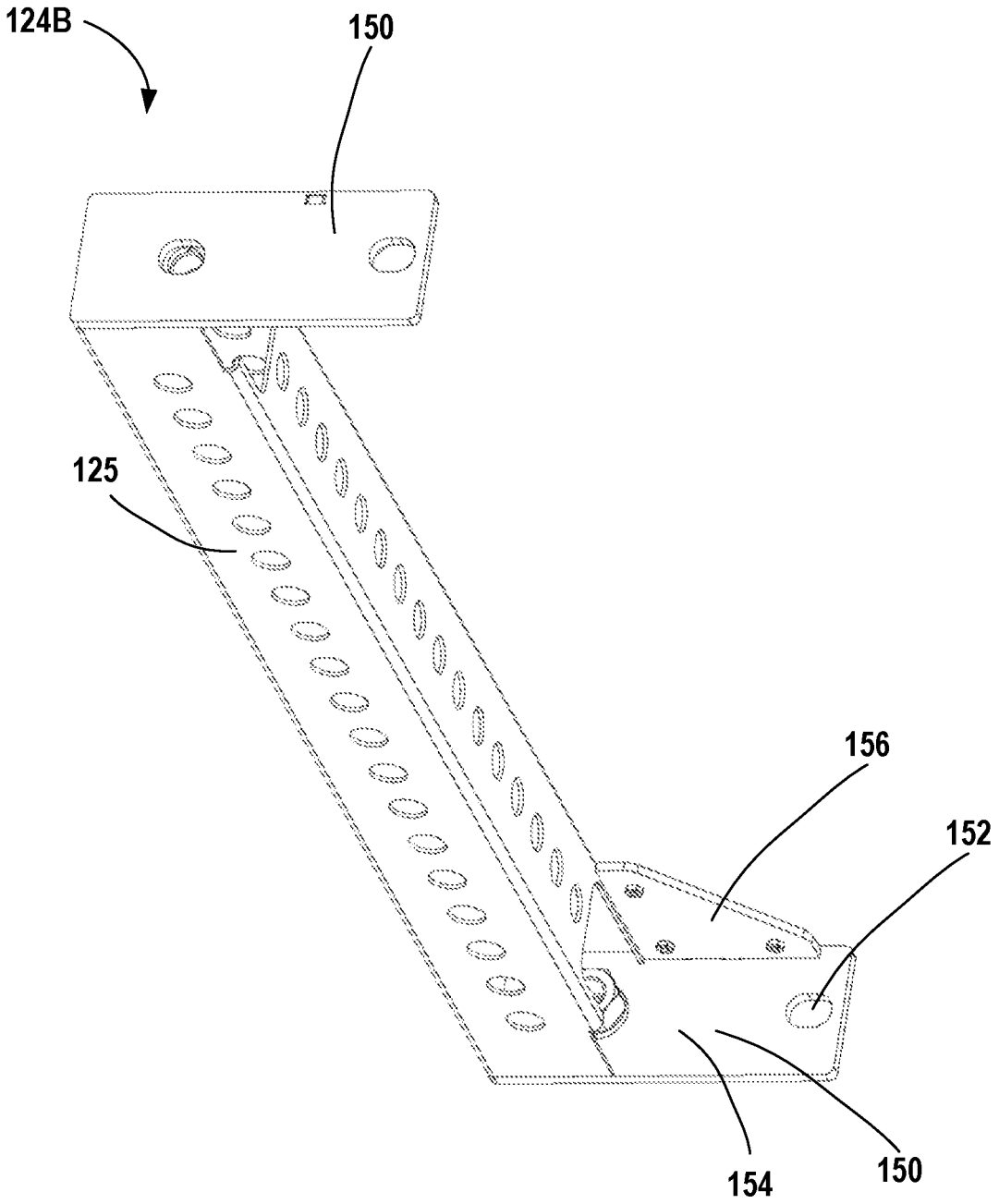
FIG. 7 illustrates a perspective view of a beam with end brackets of the weightlifting rack assembly of FIG. 2, in accordance with aspects of this disclosure.
Figure 8:
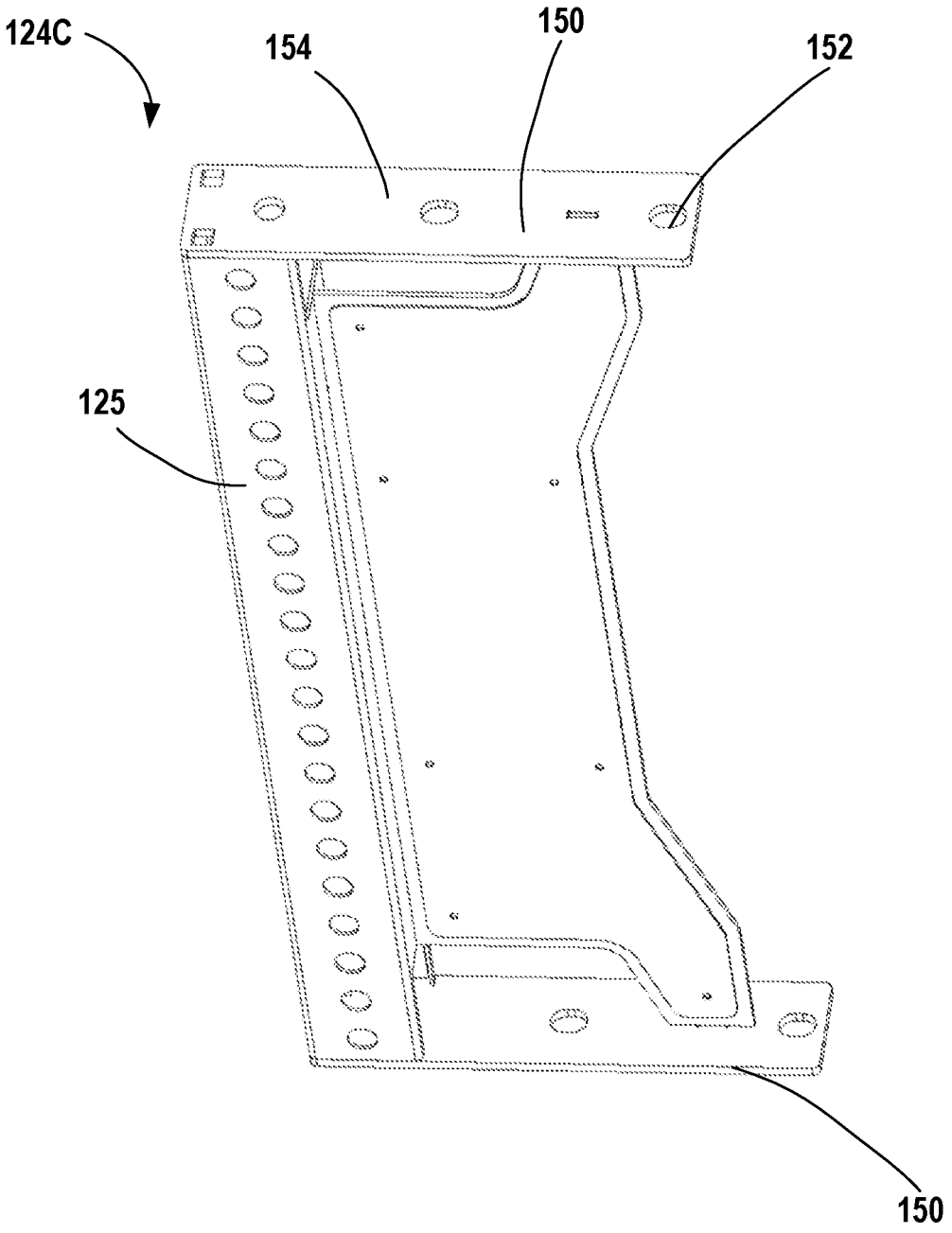
FIG. 8 illustrates a perspective view of a lateral beam of the weightlifting rack assembly of FIG. 2, in accordance with aspects of this disclosure.
Figure 9:
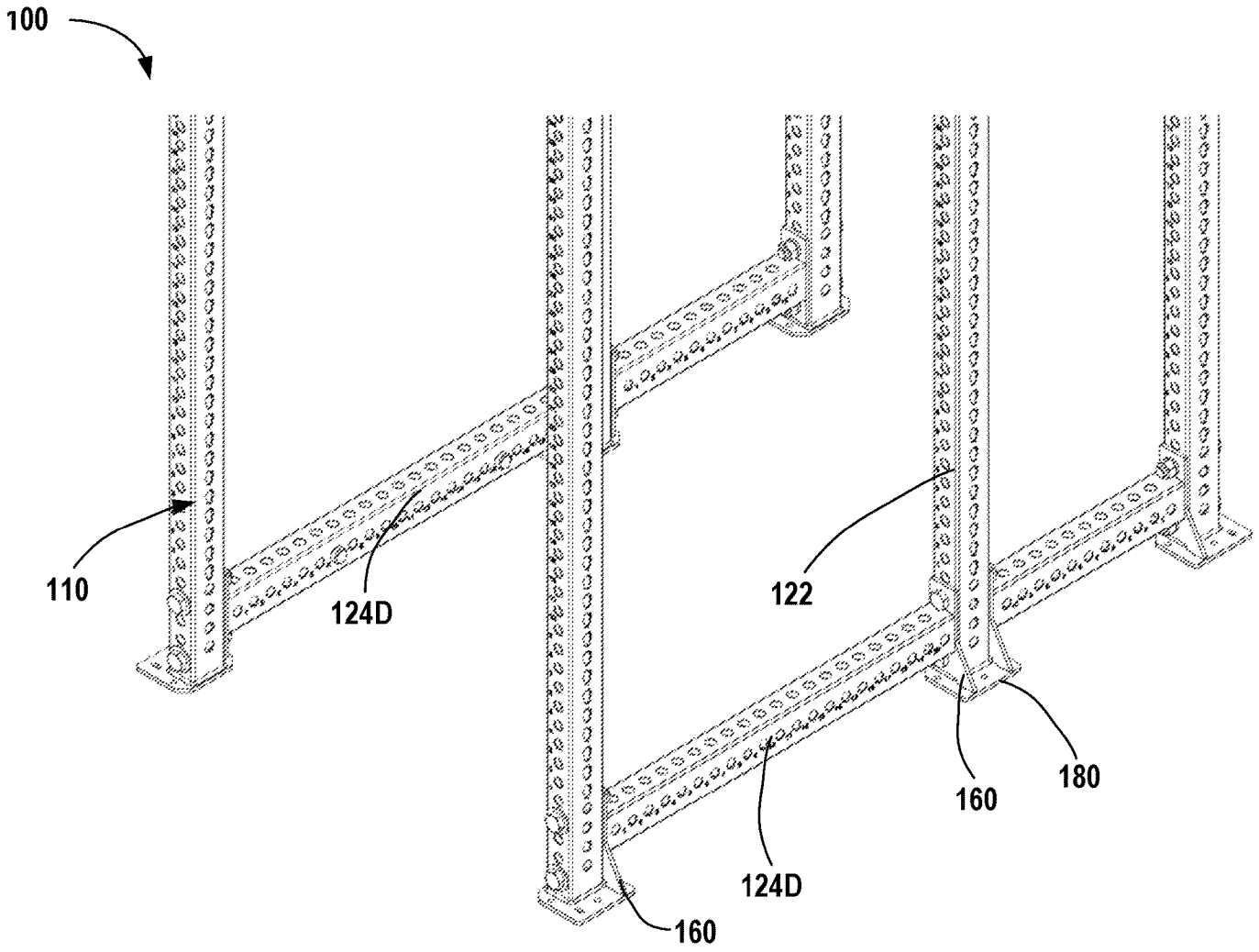
FIG. 9 illustrates a perspective view of a lower portion of the weightlifting rack assembly of FIG. 2, in accordance with aspects of this disclosure.
Figure 10:
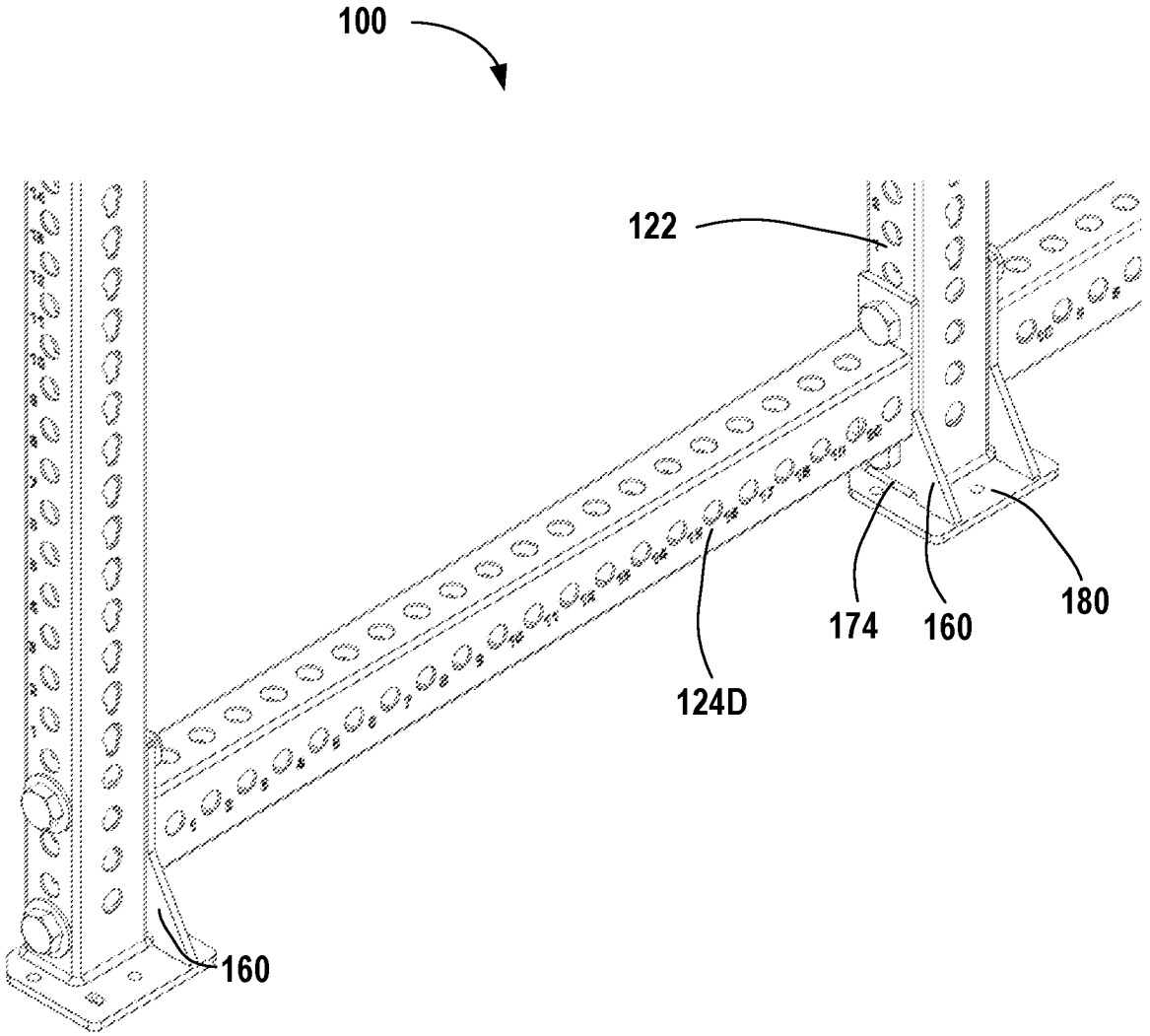
FIG. 10 illustrates a perspective view of a lower portion of the weightlifting rack assembly of FIG. 2, in accordance with aspects of this disclosure.

FIG. 7 illustrates a lateral frame member 124B that includes end brackets 150 attached to the ends of a beam member 125, such as by welding or other integral joining technique, where the end brackets 150 may include fastener holes 152, a base plate 154, and a side gusset 156 extending between the base plate 154 and a lower edge of the lateral frame member 124B. Lateral frame member 124B may arranged in a left to right or lateral direction of frame 110 of the weightlifting rack assembly 100. FIG. 8 illustrates a lateral frame member 124C with an elongated version of end bracket 150 to accommodate a name plate that may be arranged a left to right or lateral direction of frame 110 of the weightlifting rack assembly 100.

Figure 11:
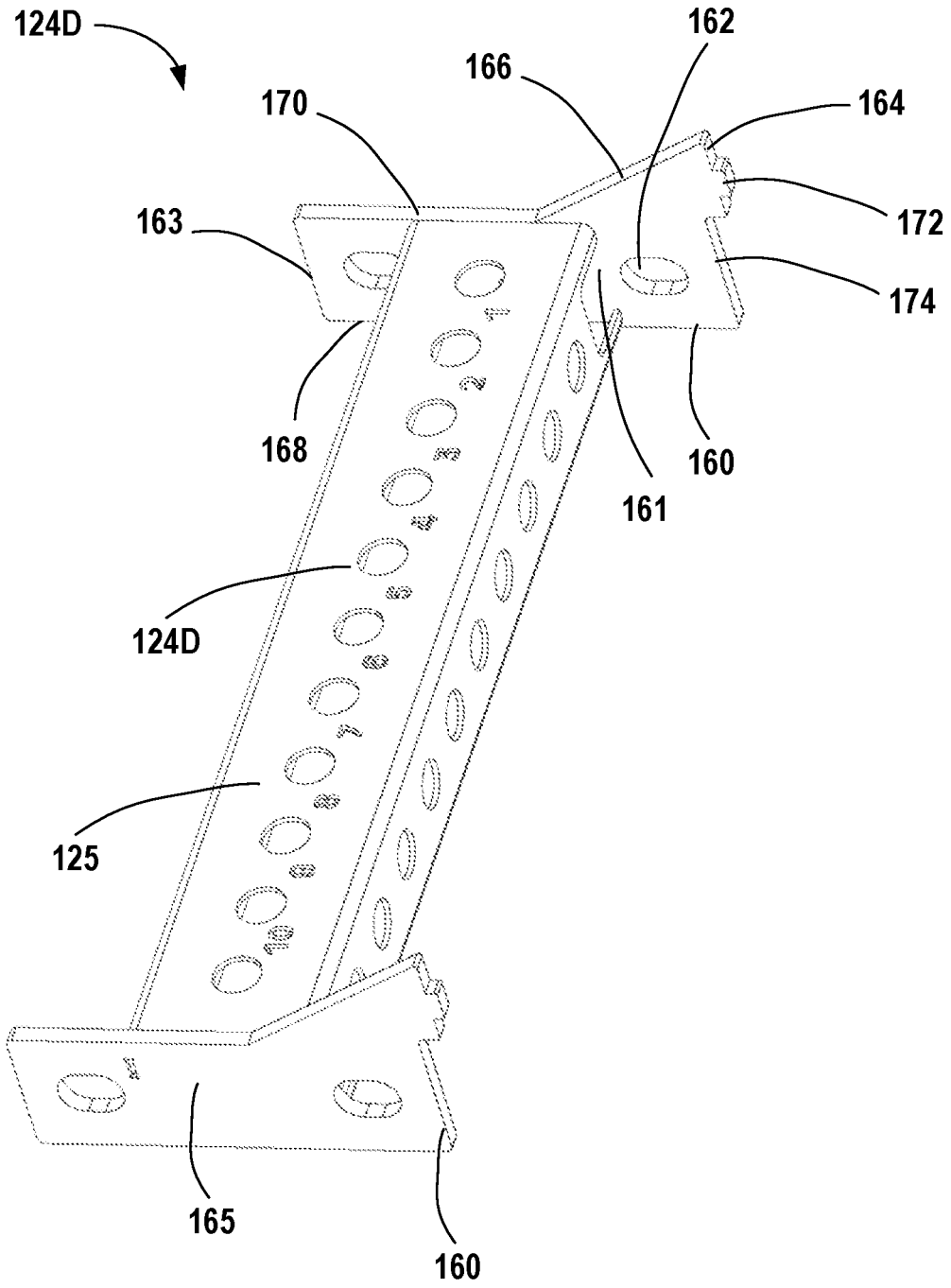
FIG. 11 illustrates a perspective view of a lower beam with bottom endplates of the weightlifting rack assembly of FIG. 2, in accordance with aspects of this disclosure.
Figure 12:
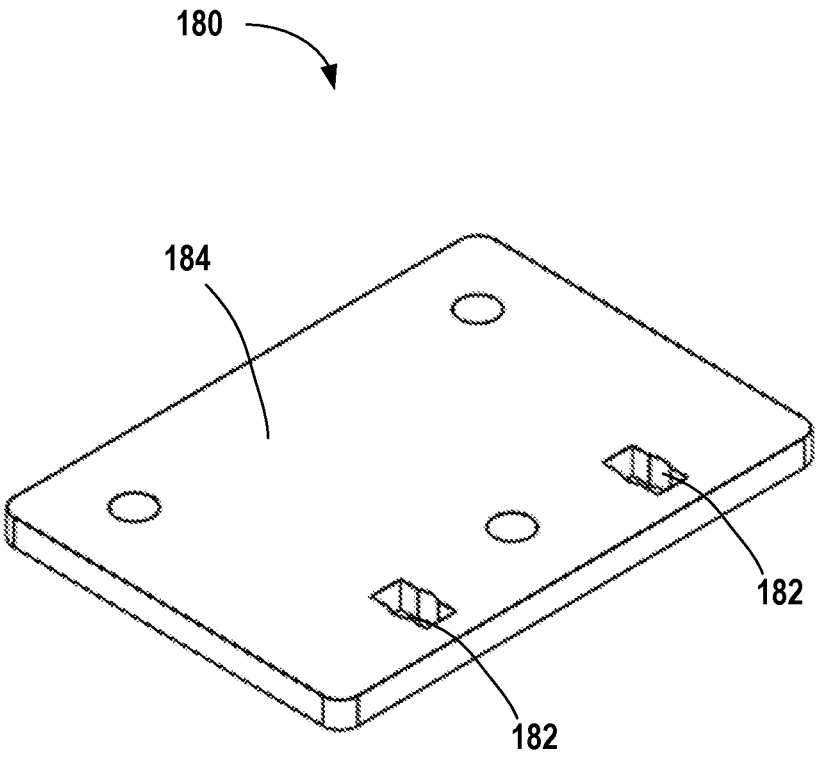
FIG. 12 illustrates a perspective view of a foot plate of the weightlifting rack assembly of FIG. 2, in accordance with aspects of this disclosure.

FIGS. 9-12 illustrate a lower portion of the frame 110 of the weightlifting rack assembly 100 with a lateral frame member 124D where the lateral frame member 124D extends in a front-to-rear direction and configured to be located near the bottom end 107 of the weight rack assembly 100. The lateral frame member 124D is positioned below the lateral frame member 124A proximate a bottom of the weight rack assembly 100. The lateral frame member 124D may include a bottom end plate 160 connected at each end of the beam member 125, such as by welding or other integral joining technique, as shown in FIG. 11, or may include a bottom end plate 160 arranged at only one end. The bottom end plate 160 may include a front surface 161 that connects to an end of the beam member 125 and a rear surface 165 opposite the front surface 165 that contacts the vertical frame member 122. The bottom end plate may also include an upper end 163, a lower end 164 opposite the upper end 163, a first side surface 168 that extends from the upper end to the lower end 164, and a second side surface 170 opposite the first side surface 168. The bottom end plate 160 may include at least one fastener opening 162 that extends through the front and rear surfaces 161, 165 to allow the bottom end plate 160 to be releasably connected to a vertical frame member 122 using a fastener. In addition, the bottom end plate 160 may include a lower end 164 that is longer than the upper end 163, where the length of each end is measured as a distance in a direction oriented from the first side surface 168 to the second side surface 170. A gusset 166 may extend from the lower end 164 towards the second side surface 170 of the bottom end plate 160. In various embodiments, the gusset 166 may extend approximately 50 percent of a height of the bottom end plate 160 or within a range of 30 and 70 percent of the height of the bottom end plate 160, where the height is measured from the lower end 164 to the upper end 163. A tab 172 may extend below the lower end 164. The tab 172 may be received in a slot 182 that is formed in the foot plate 180 as shown in FIG. 12 to reinforce the connection between the bottom end plate 160 and the foot plate 180. The foot plate 180 may be located a bottom end of the vertical frame member 122 releasably connected to the lateral frame member 124D. The bottom end plate 160 may have a constant thickness. In addition, the bottom end plate 160 may include a cutout 174 that extends from the first side surface 168 towards the opposite side and may have a length that is greater than the width of the adjacent vertical frame member 122. This cutout 174 allows the bottom end plate 160 to clear any welds or other features that are used to integrally join the foot plate 180 with the vertical frame members 122, while allowing the lower end 164 of the bottom end plate 160 to rest flush on a top surface 184 of the foot plate 180.

FIGS. 13-18 depict another exemplary weightlifting rack assembly 200. For the exemplary weight rack assembly 200 of FIGS. 13-18, the features are referred to using similar reference numerals under the "2xx" series of reference numerals, rather than "1xx" as used in the embodiment of FIGS. 1-12. Accordingly, certain features of the weightlifting rack assembly 200 that were already described above with respect to weightlifting rack assembly 100 of FIGS. 1-12 may be described in lesser detail, or may not be described at all. As discussed above, the weightlifting rack assembly 200 in FIGS. 13-18 may have square shaped cross-sectional shaped tubes 222, 224 where each side surface has the same width. In addition, the weight rack assembly 200 and frame 210 structured in the manner illustrated in FIGS. 13-18 and described herein permits construction in a modular manner to provide a wide variety of configurations as desired, including customizable sizes, layouts, and supported weightlifting structures. It is understood that the weight rack assembly 200 and frame 210 of FIGS. 13-18 are depicted in a simple form, which may be larger and more complex, with multiple weightlifting structures connected thereto.

Figure 13:
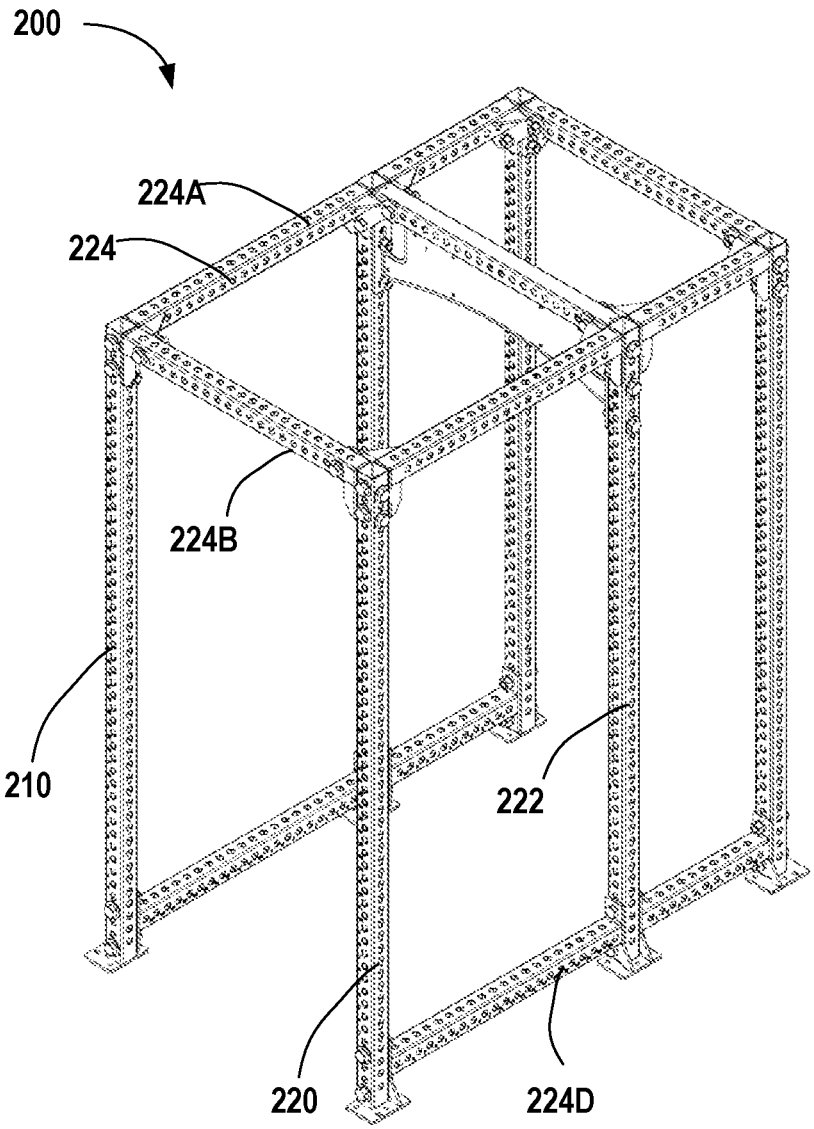
FIG. 13 illustrates a perspective view of another weightlifting rack assembly, in accordance with aspects of the disclosure.

The frame 210 may also include connecting structures for connecting the frame members 220 together to form the frame 210. The connecting structures may include a gusseted end bracket 230, an end bracket 250, and a bottom end plate 260. These connecting structures may help to stabilize the frame members 222, 224 together to provide a stable platform for various weightlifting machines. The frame 210 may include a plurality of gusseted end brackets 230, end brackets 250, and bottom end plates 260 as shown in FIG. 13. The gusseted end brackets 230, end brackets 250, and bottom end plates 260 may be integrally joined to various lateral frame members 224, such as by using an integral joining technique, and removably joined to other frame members 222, 224. As described in more detail below, the gusseted end brackets 230, straight end brackets 150, and bottom end plates 160 each comprise one or more fastener holes 232, 252, 262 that are configured to receive a fastener 115 that may also extend into a corresponding fastener hole 226 in a vertical frame member 222 to connect the lateral frame members 224 to the vertical frame members 222.

Figure 14:
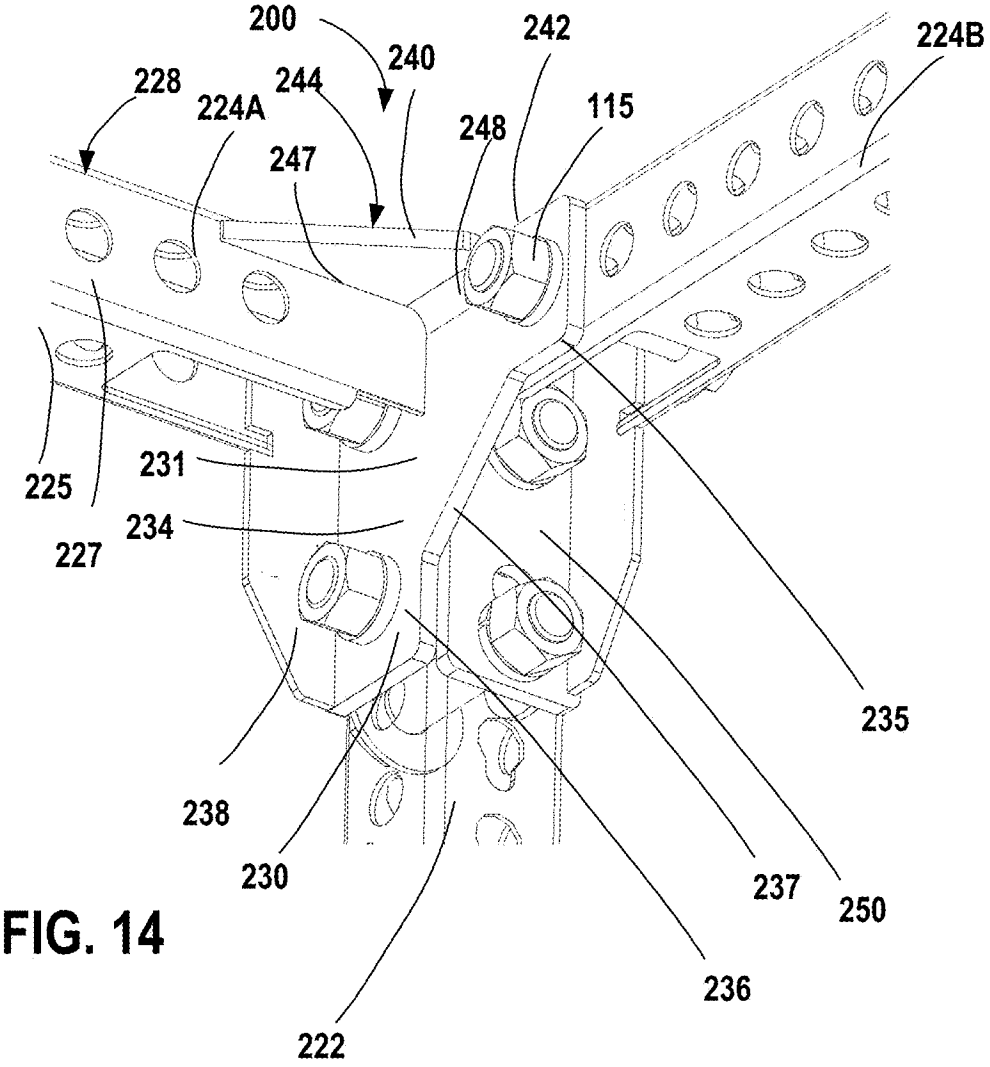
FIG. 14 illustrates a perspective view of an exemplary joint of the weightlifting rack of the weightlifting rack assembly of FIG. 13, in accordance with aspects of this disclosure.
Figure 15:
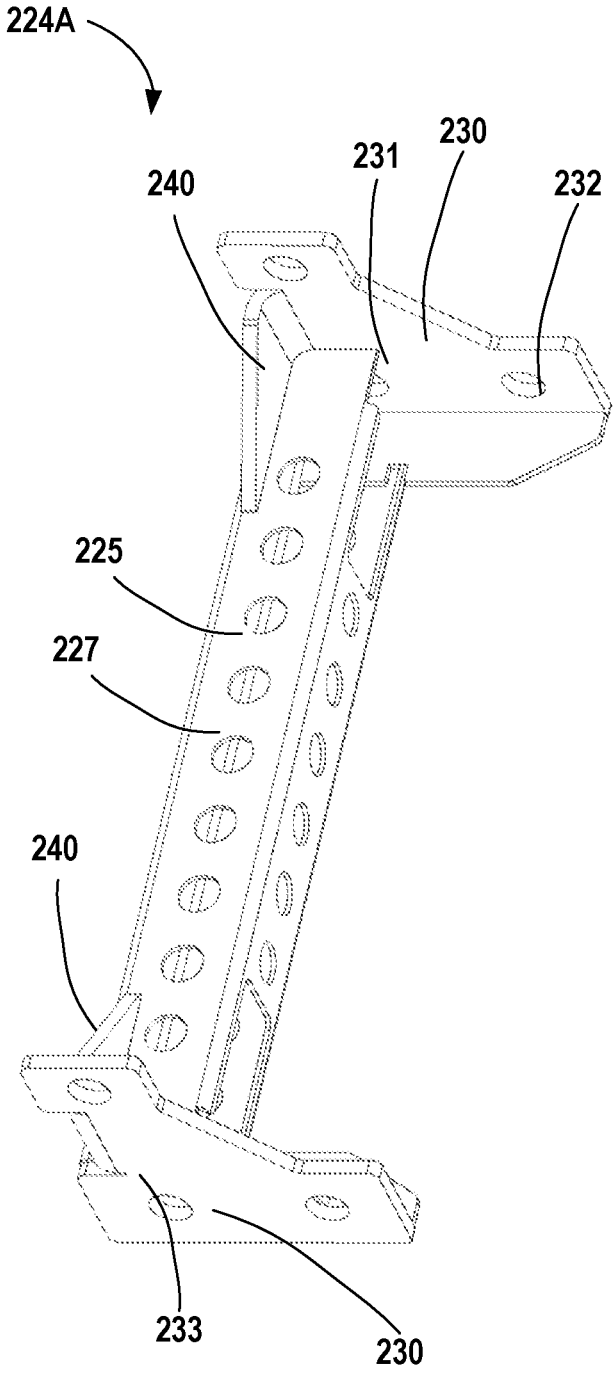
FIG. 15 illustrates a perspective view of a beam with exemplary gusseted end brackets of the weightlifting rack assembly of FIG. 13, in accordance with aspects of this disclosure.

As shown in FIG. 14, the gusseted end brackets 230 may be used to connect upper lateral frame members 224A to the vertical frame members 222 and/or to other upper lateral frame members 224. In the illustrated examples, the gusseted end brackets 230 may be connected to the lateral frame members 224A that are arranged in a front to rear direction. FIG. 15 illustrates a lateral frame member 224A that includes a gusseted end bracket 230 connected at each end of the beam member 225, such as by welding or other integral joining technique, however it is contemplated that a lateral frame member 224A may be arranged with a gusseted end bracket 230 at only one end and different connecting structure at the other end. The gusseted end brackets 230 may include a plurality of fastener holes 232 that extend through a base plate 234, where the base plate 234 may include a lateral extension 235 and a vertical extension 236 that may extend in a substantially perpendicular direction to each other, such that the base plate 234 generally has an "L" shape. The lateral and vertical extensions 235, 236 may also include a base gusset 237 that extends between the lateral and vertical extensions 235, 236. The base plate 234 may have a front surface 231 that connects to the end of the beam member 225 and a rear surface 233 opposite the front surface 231. In addition, the gusseted end bracket 230 may include a top gusset 240 that extends from an upper edge 242 of the lateral extension 235 in a direction substantially parallel to and along a side of the lateral frame member 224. The top gusset 240 may have a top surface 244 that is coplanar with or below a top surface 228 of its corresponding lateral frame member 224A. Accordingly, none of the top gussets 240 of will be above any of the top surfaces 228 of the lateral frame members 224. The top gusset 240 may be arranged to extend along an outer side surface 227 of its corresponding lateral frame member 224. The top gusset 240 may also be integrally joined to the side surface 227 or may extend along the side surface 227 without being fixedly attached to its corresponding lateral frame member 224. The top gusset 240 may brace the lateral frame member 224A against other frame members 222, 224 to help to reduce any side-to-side and fore and aft movement of the frame 210. In addition, the gusseted end bracket 230 may also include a side gusset 238 that extends between the vertical extension 236 and an exterior facing outward surface 229 of its corresponding lateral frame member 224. The side gusset 238 may be integrally joined to a lower edge of the exterior facing outward surface 229 or may extend along the side surface 227 without being fixedly attached to its corresponding lateral frame member 224A.

The top gusset 240 may have a generally triangular shape. In the illustrated examples, a length of a first side 247 of the top gusset 240 that extends along the lateral frame member 224A is longer than a length of a second side 248 of the top gusset 240 that extends along the lateral extension 235. In some examples, the length of the first side 247 may be approximately 1.7 times greater than the length of the second side 248 or, in some examples, the length of the first side 247 may be within a range of the same length (i.e., equal to) the length of the second side 248 to up to 2 times greater than the length of the second side 248.

Figure 16:
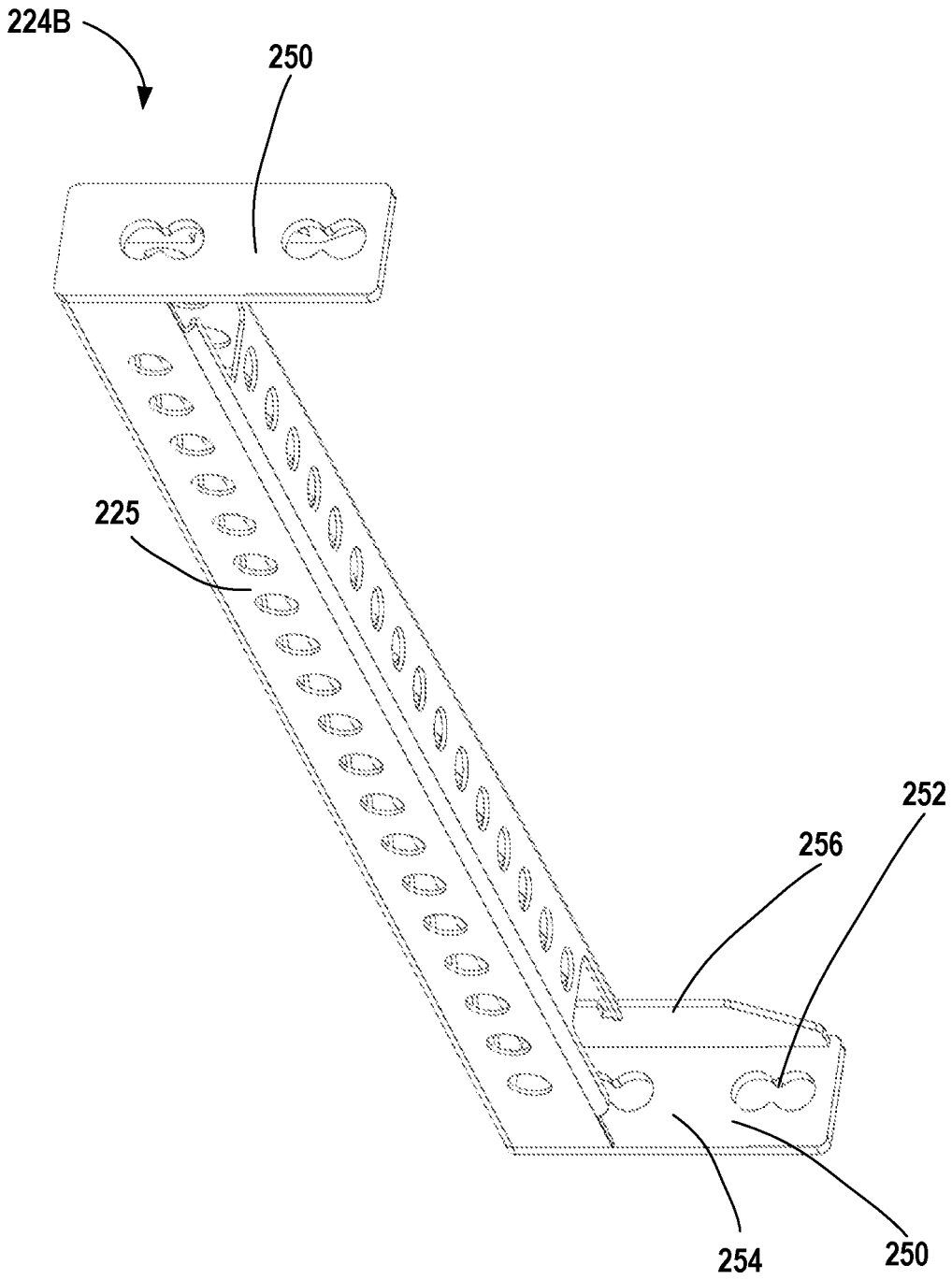
FIG. 16 illustrates a perspective view of a beam with exemplary end brackets of the weightlifting rack assembly of FIG. 13, in accordance with aspects of this disclosure.

FIG. 16 illustrates a lateral frame member 224B that includes end brackets 250 attached to the ends of a beam member 225, where the end brackets 250 may include have fastener holes 252, a base plate 254, and a side gusset 256 extending between the base plate 254 and a lower edge of the lateral frame member 224B. Lateral frame member 224B may arranged in a left to right or lateral direction of frame 210 of the weightlifting rack assembly 200.

Figure 17:
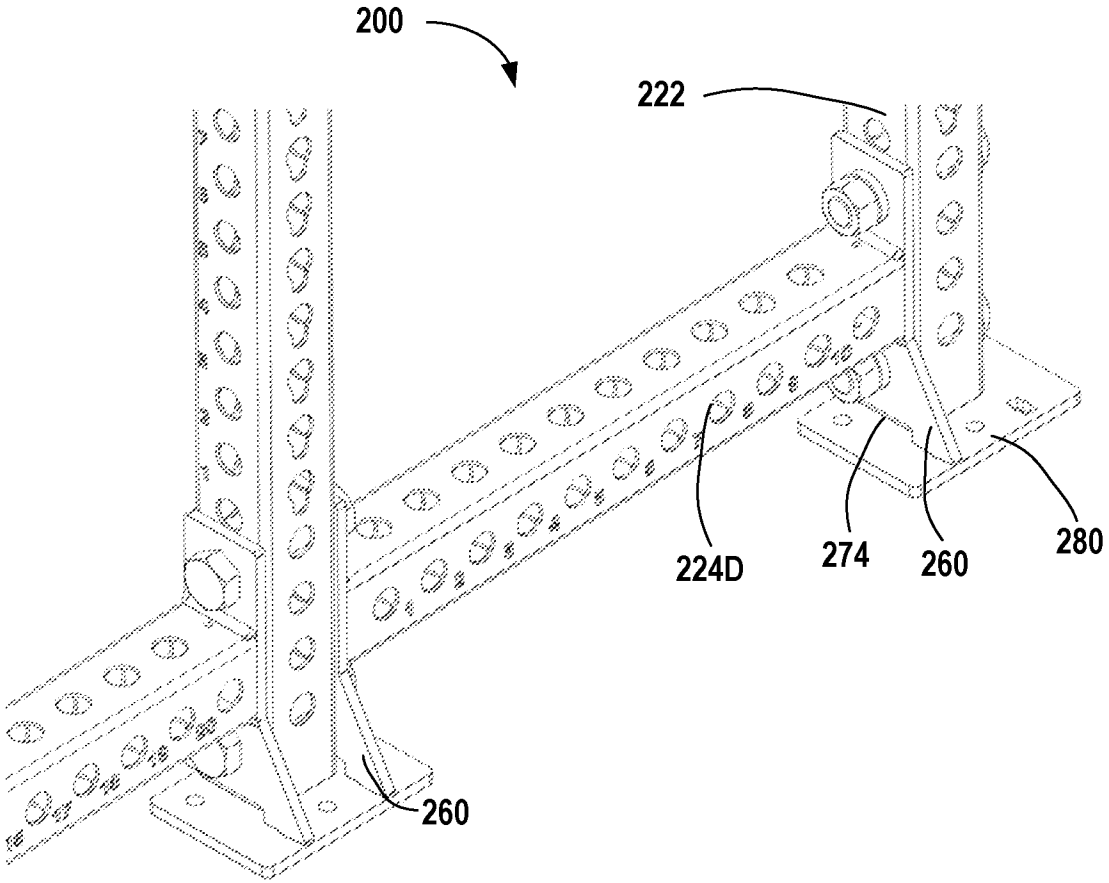
FIG. 17 illustrates a perspective view of a lower portion of the weightlifting rack assembly of FIG. 13, in accordance with aspects of this disclosure.
Figure 18:
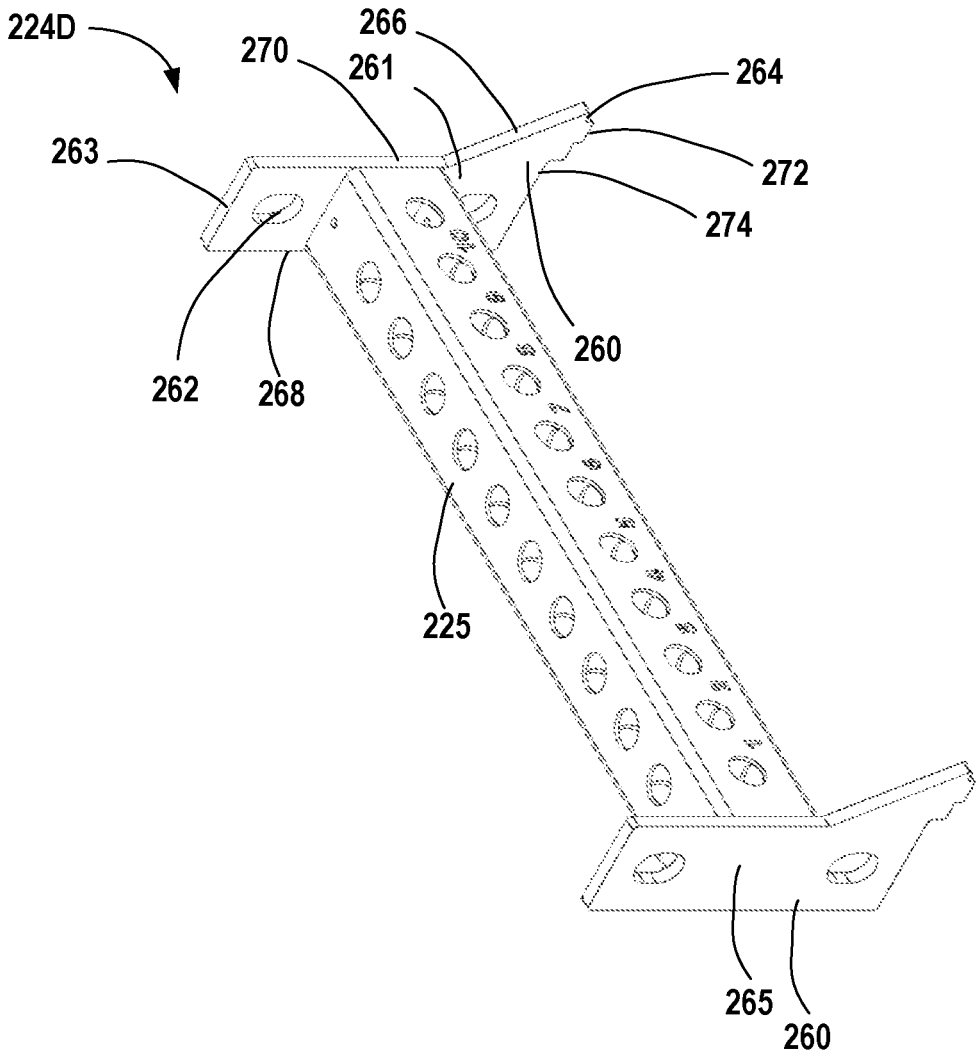
FIG. 18 illustrates a perspective view of a lower beam with a bottom endplate of the weightlifting rack assembly of FIG. 13, in accordance with aspects of this disclosure.

FIGS. 17-18 illustrate a lower portion of the frame 110 of the weightlifting rack assembly 200 with a lateral frame member 224D where the lateral frame member 224D extends in a front-to-rear direction and configured to be located near the bottom of the weight rack assembly 200. The lateral frame member 224D may include a bottom end plate 260 connected at each end to the beam member 225, such as by welding or other integral joining technique, as shown in FIG. 18, or may include a bottom end plate 260 arranged at only one end. The bottom end plate 260 may include a front surface 261 that connects to an end of the beam member 225 and a rear surface 265 opposite the front surface 265. The bottom end plate 260 may include at least one fastener opening 262 to allow the bottom end plate 260 to be releasably connected to a vertical frame member 222 using a fastener. In addition, the bottom end plate may include a lower end 264 that is longer than the upper end 263, where the length of each end is measured as a distance in a direction oriented from a first side surface 268 to a second side surface 270. A gusset 266 may extend from the lower end 264 towards the second side surface 270 of the bottom end plate 260. In various embodiments, the gusset 266 may extend approximately 50 percent of a height of the bottom end plate 260 or within a range of 30 and 70 percent of the height of the bottom end plate 160, where the height is measured from the lower end 264 to the upper end 263. A tab 272 may extend below the lower end 264. The tab 272 may be received in a slot 282 that is formed in the foot plate 180 as shown in FIG. 12 to reinforce the connection between the bottom end plate 160 and the foot plate 180. The bottom end plate 260 may have a constant thickness. In addition, the bottom end plate 260 may include a cutout 274 that extends from the first side surface 268 towards the opposite side and may have a length that is greater than the width of the adjacent vertical frame member 222. This cutout 274 allows the bottom end plate 260 to clear any welds or other features that are used to integrally join the foot plate 180 with the vertical frame members 222, while allowing the lower end 264 of the bottom end plate 160 to rest flush on a top surface 184 of the foot plate 180.

The various embodiments described herein enable connection of a cable-based weightlifting machine to a traditional weight rack assembly in a time-efficient and cost-efficient manner. The components of the weightlifting machine are easily and quickly connectable to a weight rack assembly using the existing connections of the weight rack assembly. In other embodiments, the weight rack assemblies 100, 200 may be provided with any combination of such components and features. It is also understood that in other embodiments, the various devices, components, and features of the weight rack assemblies described herein may be constructed with similar structural and functional elements having different configurations, including different ornamental appearances. Still other benefits may be recognized by those skilled in the art. Accordingly, while the specific embodiments have been illustrated and described, numerous modifications come to mind without significantly departing from the spirit of the invention and the scope of protection is only limited by the scope of the accompanying claims.

What is claimed is:

1. A weight rack assembly, comprising:

a plurality of vertical frame members, wherein each of the plurality of vertical frame members comprises a beam member with a rectangular cross-sectional shape; and a plurality of lateral frame members extending between the plurality of vertical frame members, wherein each of the plurality of lateral frame members comprises a beam member with a rectangular cross-sectional shape; and wherein a first lateral frame member of the plurality of lateral frame members comprises a first beam member, a first gusseted end bracket at a first end of the first beam member, wherein the first gusseted end bracket includes a first base plate at the first end of the first beam member, a first lateral extension extending laterally from the first base plate, a first vertical extension extending vertically downward from the first base plate, and a first top gusset that extends from an upper edge of the first lateral extension along a side surface of the first beam member;

wherein the first top gusset is integrally formed with the first base plate by a bending operation;

wherein a second lateral frame member of the plurality of lateral frame members is positioned below the first lateral frame member proximate a bottom of the weight rack assembly and includes a bottom end plate at one end, wherein the bottom end plate includes a tab that extends from a lower surface of the bottom end plate; and wherein the tab of the bottom end plate is received in a slot on a foot plate.

2. The weight rack assembly of claim 1, wherein a first fastener extends through a first opening in the first vertical extension of the first gusseted end bracket to releasably connect the first lateral frame member to a first vertical frame member of the plurality of vertical frame members.

3. The weight rack assembly of claim 2, the weight rack assembly further comprising a third lateral frame member of the plurality of lateral frame members, wherein the third lateral frame member comprises a third beam member, a third gusseted end bracket that includes a third base plate at a first end of the third beam member, a third lateral extension extending laterally from the third base plate, a third vertical extension extending vertically downward from the third base plate, and a third top gusset that extends from an upper edge of the third lateral extension along a side surface of the third beam member; and wherein the first lateral frame member and the third lateral frame member are arranged on opposite sides of the first vertical frame member.

4. The weight rack assembly of claim 1, wherein a second fastener releasably connects the first lateral frame member to a third lateral frame member of the plurality of lateral frame members.

5. The weight rack assembly of claim 1, wherein the first gusseted end bracket is integrally joined at the first end of the first beam member.

6. The weight rack assembly of claim 1, wherein the first lateral frame member includes a second gusseted end bracket at a second end of the first beam member opposite the first end, wherein the second gusseted end bracket includes a second base plate at the second end of the first beam member, a second lateral extension extending laterally from the second base plate, a second vertical extension extending vertically downward from the second base plate, and a second top gusset that extends from an upper edge of the second lateral extension along the side surface of the first beam member.

7. The weight rack assembly of claim 1, wherein the first gusseted end bracket includes a first side gusset extending between the first vertical extension and an exterior facing surface of the first beam member.

8. The weight rack assembly of claim 1, wherein the first top gusset, the first lateral extension, the first vertical extension, and the first base plate are integrally formed as a single piece of metal plate.

9. A weight rack assembly, comprising:

a plurality of vertical frame members, wherein each of the plurality of vertical frame members comprises a beam member with a rectangular cross-sectional shape;

a plurality of lateral frame members extending between the plurality of vertical frame members, wherein each of the plurality of lateral frame members comprises a beam member with a rectangular cross-sectional shape; and a foot plate located at a bottom end of a first vertical frame member of the plurality of vertical frame members, wherein a first lateral frame member of the plurality of lateral frame members comprises a first beam member, a bottom end plate at a first end of the first beam member, such that the bottom end plate is connected to the first vertical frame member, wherein the bottom end plate includes an upper end, a lower end opposite the upper end, a first side surface that extends from the upper end to the lower end, and a second side surface opposite the first side surface, and a tab that extends from the lower end of the bottom end plate, and wherein the tab of the bottom end plate is received in a slot on the foot plate.

10. The weight rack assembly of claim 9, wherein the bottom end plate further includes a gusset that extends from the lower end toward the second side surface.

11. The weight rack assembly of claim 10, wherein the gusset has a height within a range of 30 percent and 70 percent of a height of the bottom end plate, wherein the height of the bottom end plate is measured from the upper end to the lower end.

12. The weight rack assembly of claim 9, wherein the bottom end plate is integrally joined to the first beam member at the first end of the first lateral frame member.

13. The weight rack assembly of claim 9, wherein a first fastener extends through an opening in the bottom end plate to releasably connect the first lateral frame member to the first vertical frame member.

14. The weight rack assembly of claim 9, wherein the lower end of the bottom end plate rests on a top surface of the foot plate.

15. The weight rack assembly of claim 9, wherein a second lateral frame member of the plurality of lateral frame members comprises a second beam member, a gusseted end bracket at a first end of the second beam member, wherein the gusseted end bracket includes a base plate at the first end of the second beam member, a lateral extension extending laterally from the base plate, a vertical extension extending vertically downward from the base plate, and a top gusset that extends from an upper edge of the lateral extension along a side surface of the second beam member.

16. A weight rack assembly, comprising:

a plurality of vertical frame members, wherein each of the plurality of vertical frame members comprises a beam member with a rectangular cross-sectional shape;

a plurality of lateral frame members extending between the plurality of vertical frame members, wherein each of the plurality of lateral frame members comprises a beam member with a rectangular cross-sectional shape;

wherein a first lateral frame member of the plurality of lateral frame members comprises a first beam member, a gusseted end bracket that is integrally joined at a first end of the first beam member, wherein the gusseted end bracket includes a base plate at the first end of the first beam member, a lateral extension extending laterally from the base plate, a vertical extension extending vertically downward from the base plate, and a top gusset that extends from an upper edge of the lateral extension along a side surface of the first beam member;

wherein a first fastener releasably connects the first lateral frame member to a first vertical frame member of the plurality of vertical frame members;

a foot plate located at a bottom end of the first vertical frame member; and wherein a second lateral frame member of the plurality of lateral frame members comprises a second beam member, a bottom end plate that is integrally joined at a first end of the second beam member, such that the bottom end plate is connected to the first vertical frame member, wherein the bottom end plate comprises an upper end, a lower end opposite the upper end, a first side surface that extends from the upper end to the lower end, and a second side surface opposite the first side surface, and a tab that extends from the lower end of the bottom end plate, and wherein a second fastener releasably connects the second lateral frame member to the first vertical frame member; and wherein the tab of the bottom end plate is received in a slot on the foot plate.

17. The weight rack assembly of claim 16, wherein the top gusset has a top surface that is below a top surface of the first beam member.

18. The weight rack assembly of claim 16, wherein the top gusset is integrally joined to the side surface of the first beam member.

19. The weight rack assembly of claim 16, wherein the bottom end plate further includes a gusset that extends from the lower end toward the second side surface, and wherein the gusset has a height within a range of 30 percent and 70 percent of a height of the bottom end plate, wherein the height of the bottom end plate is measured from the upper end to the lower end therefor.

* * * * *